US006293734B1

(12) United States Patent
Thomas et al.

(10) Patent No.: US 6,293,734 B1
(45) Date of Patent: Sep. 25, 2001

(54) APPARATUS FOR TRANSPORTING AND INSTALLING A DECK OF AN OFFSHORE OIL PRODUCTION PLATFORM

(75) Inventors: Pierre-Armand Thomas, Puteaux; Jean-Christophe Oudin, Pau, both of (FR)

(73) Assignee: Technip France, Courbevoie (FR)

( * ) Notice: Subject to any disclaimer, the term of this patent is extended or adjusted under 35 U.S.C. 154(b) by 0 days.

(21) Appl. No.: 09/329,327

(22) Filed: Jun. 10, 1999

(30) Foreign Application Priority Data

Jun. 12, 1998 (FR) ..... 98 07 456

(51) Int. Cl.[7] ..... E02D 25/00

(52) U.S. Cl. ..... 405/209; 405/209; 405/204; 405/203; 114/264; 114/265

(58) Field of Search ..... 405/203, 204, 405/209; 114/264, 265

(56) References Cited

U.S. PATENT DOCUMENTS

| | | | | |
|---|---|---|---|---|
| 3,138,932 | | 6/1964 | Kofahl et al. | 405/209 |
| 3,727,414 | * | 4/1973 | Davies | 405/204 |
| 3,797,256 | * | 3/1974 | Giblon | 405/196 |
| 4,007,914 | * | 2/1977 | Sutton | 405/198 |
| 4,015,434 | * | 4/1977 | Tarrant | 114/265 |
| 4,161,376 | | 7/1979 | Armstrong | 405/204 |
| 4,203,576 | * | 5/1980 | Sutton | 254/95 |
| 4,242,011 | * | 12/1980 | Karsan et al. | 405/204 |
| 4,252,468 | * | 2/1981 | Blight | 405/204 |
| 4,252,469 | * | 2/1981 | Blight et al. | 405/204 |
| 4,255,069 | * | 3/1981 | Yielding | 405/196 |
| 4,329,088 | * | 5/1982 | Lucas | 405/203 |
| 4,382,718 | * | 5/1983 | Inoue et al. | 405/204 |
| 4,411,408 | | 10/1983 | Radovan et al. | 254/108 |
| 4,436,454 | | 3/1984 | Ninet et al. | 405/204 |
| 4,482,272 | * | 11/1984 | Colin | 405/198 |
| 4,512,553 | * | 4/1985 | Dunham et al. | 254/89 R |
| 4,556,004 | | 12/1985 | Lamy et al. | 405/209 |
| 4,607,982 | | 8/1986 | Brasted et al. | 405/204 |
| 4,627,767 | * | 12/1986 | Field et al. | 405/204 |
| 4,655,641 | | 4/1987 | Weyler | 405/204 |
| 4,657,437 | * | 4/1987 | Breeden | 405/198 |
| 4,662,788 | | 5/1987 | Kypke et al. | 405/204 |
| 4,848,967 | | 7/1989 | Weyler | 405/204 |
| 4,930,938 | | 6/1990 | Rawstron et al. | 405/204 |
| 5,139,367 | | 8/1992 | Ingle | 405/209 |
| 5,219,451 | * | 6/1993 | Datta et al. | 405/209 |
| 5,290,128 | | 3/1994 | Yeargain et al. | 405/209 |
| 5,403,124 | * | 4/1995 | Kocaman et al. | 405/209 |
| 5,522,680 | | 6/1996 | Hoss et al. | 405/209 |
| 5,799,603 | * | 9/1998 | Tellington | 114/264 |
| 5,975,806 | * | 11/1999 | Delamatyr | 405/203 |
| 6,030,148 | * | 2/2000 | Tormala et al. | 405/209 |

FOREIGN PATENT DOCUMENTS

| | | | | |
|---|---|---|---|---|
| 936005 | * | 10/1973 | (CA) | 405/209 |
| 0070212 | * | 4/1985 | (JP) | 405/209 |

* cited by examiner

*Primary Examiner*—Thomas B. Will
*Assistant Examiner*—Alexandra K Pechhold
(74) *Attorney, Agent, or Firm*—Wenderoth, Lind & Ponack, L.L.P.

(57) ABSTRACT

Apparatus for transporting and installing a deck of an offshore oil production comprises a floating barge (10) adapted to support the deck (1) and provided with devices for moving the deck (1). The apparatus includes a support framework (11) for the deck (1) adapted to be placed on the barge (10) and including the devices for moving the deck (1) in the form of at least one rack (21) that can be moved vertically by drive mechanisms (20).

8 Claims, 8 Drawing Sheets

Figure 1:
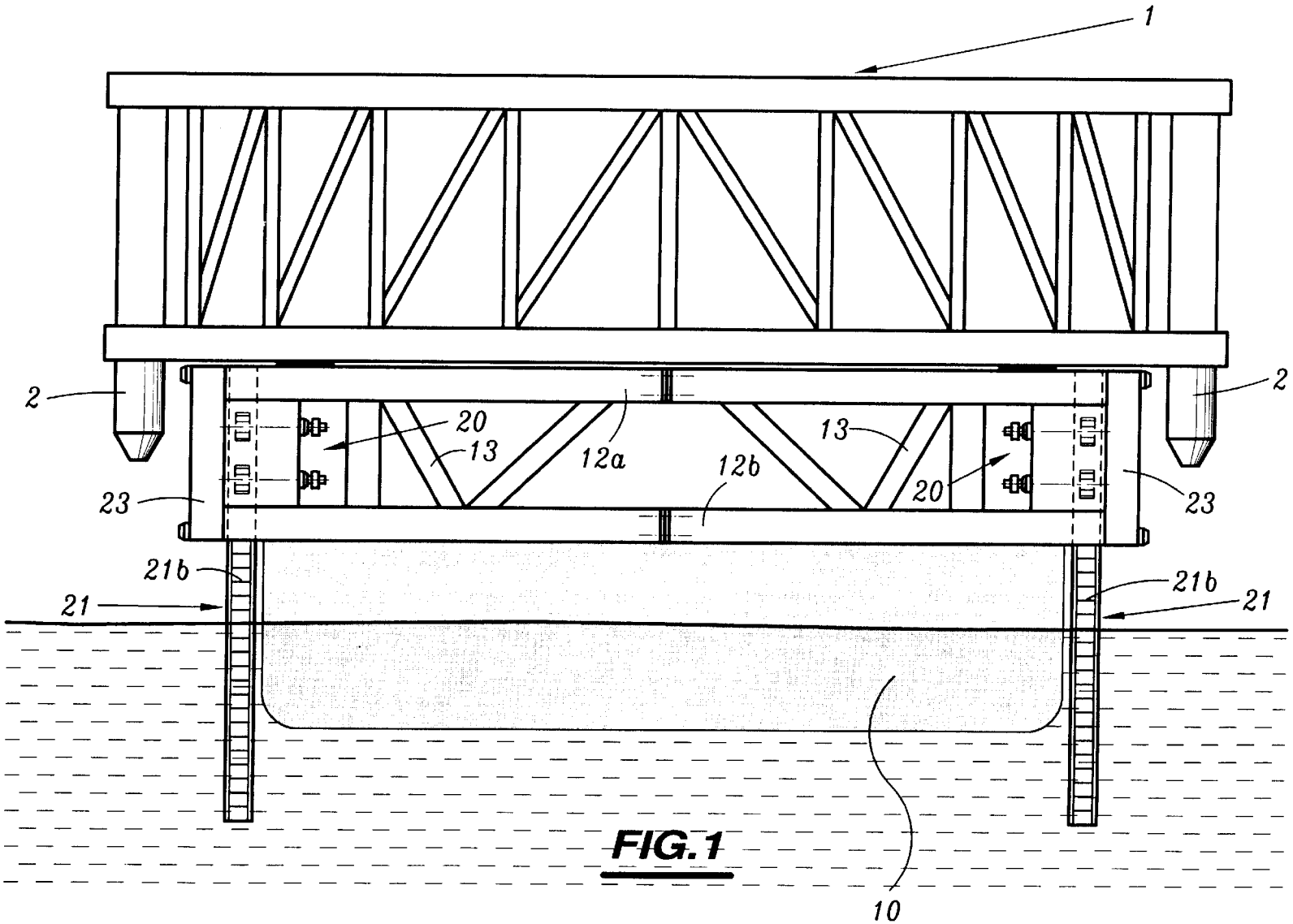

APPARATUS FOR TRANSPORTING AND INSTALLING A DECK OF AN OFFSHORE OIL PRODUCTION PLATFORM

BACKGROUND OF THE INVENTION

The present invention consists in apparatus for transporting and installing a deck of an offshore oil production platform.

Offshore oil production platforms generally include a deck carrying production equipment and crew's quarters.

The deck is supported by tubular piles or legs driven into the sea floor or resting thereon on shoes.

There are various ways to install this kind of platform at the production site.

The first consists in floating all of the platform to the production site, lowering the legs until they contact the sea floor and then, using the legs as supports, raising the deck above the water to a height such that it is out of reach of the highest waves.

The second installation method consists in first placing the legs on the sea floor and transporting the deck of the platform from the assembly yard to the site on a barge with dimensions compatible with the size of the deck.

The problem is then to transfer the deck from the barge to the upper ends of the legs, because the deck is on a floating body affected by swells and, like the body carrying it, is subject to a continuous orbital motion the amplitude of which depends on the height of the swell.

What is more, the deck has a very high mass, possibly several thousand ton, which does not facilitate transferring the deck.

The barge carrying the deck is placed between the legs of the platform and the deck is transferred from the barge to the legs of the platform either by ballasting the barge or by lifting equipment on the barge.

Ballasting the barge is a lengthy operation which takes several hours and the height to which the deck is raised is small, which means that this method cannot be used to install the deck at places where heavy seas may be experienced because it will not be at a sufficient height to be out of reach of the highest waves.

Raising the deck by means of jacks has the main drawback that jacks are sensitive to lateral forces, making it necessary to install protection and guide structures that add to the weight of the equipment installed on the barge.

Moreover, the travel of jacks is limited.

SUMMARY OF THE INVENTION

The invention aims to remedy the drawbacks of the prior art apparatus by proposing apparatus for transporting and installing an oil platform deck that is designed to enable the deck to be raised through a great height, in the order of 10 to 20 meters, and saves a considerable amount of time.

The invention therefore consists in apparatus for transporting and installing a deck of an offshore oil production platform, of the type comprising a floating barge adapted to support the deck and provided with a means or system for moving the deck between a position resting on the barge and a position resting on the legs of the platform, characterised in that the appartus includes a support framework for the deck adapted to be placed on the barge and including the means for moving the deck in the form of at least one rack that can be moved vertically by a drive mechanism.

According to other features of the invention:

the support framework comprises at least one top beam and at least one bottom beam connected together by spacers and extending transversely relative to the axis of the barge, the beams supporting at each end a rack and a drive mechanisms, the lengths of the beams can be adjusted to modify the distance between the racks, the rack is formed by a plate having a series of teeth on each of its lateral faces and the drive mechanism comprises at least two opposed combinations each formed of a motor associated with at least one gearbox driving an output gear cooperating with one of the series of teeth of the rack, the combination of each drive mechanism is mounted in a structure connected to the beams by impact-absorbing units, the rack has an impact-absorbing shoe at its upper end, the apparatus includes a connecting means (or connecting device) for connecting the rack to the deck of the platform which can be disconnected after ballasting the barge, the connecting means comprise a rod one end of which is connected to the rack and the other end of which is connected to the deck, the rod having a portion of small cross section adapted to break at a particular load, the connecting means comprise a rod one end of which is connected to a rack or the deck and the other end of which is connected to the deck or a rack, respectively, by at least one locking member that can be moved transversely relative to the axis of the rod and is operated by an actuator unit, the locking unit is formed by a finger adapted to cooperate with a groove in the rod, the finger is wedge-shaped and the groove has a cross section of complementary shape to the finger, and the actuator unit is a jack.

BRIEF DESCRIPTION OF THE INVENTION

Figure 2:
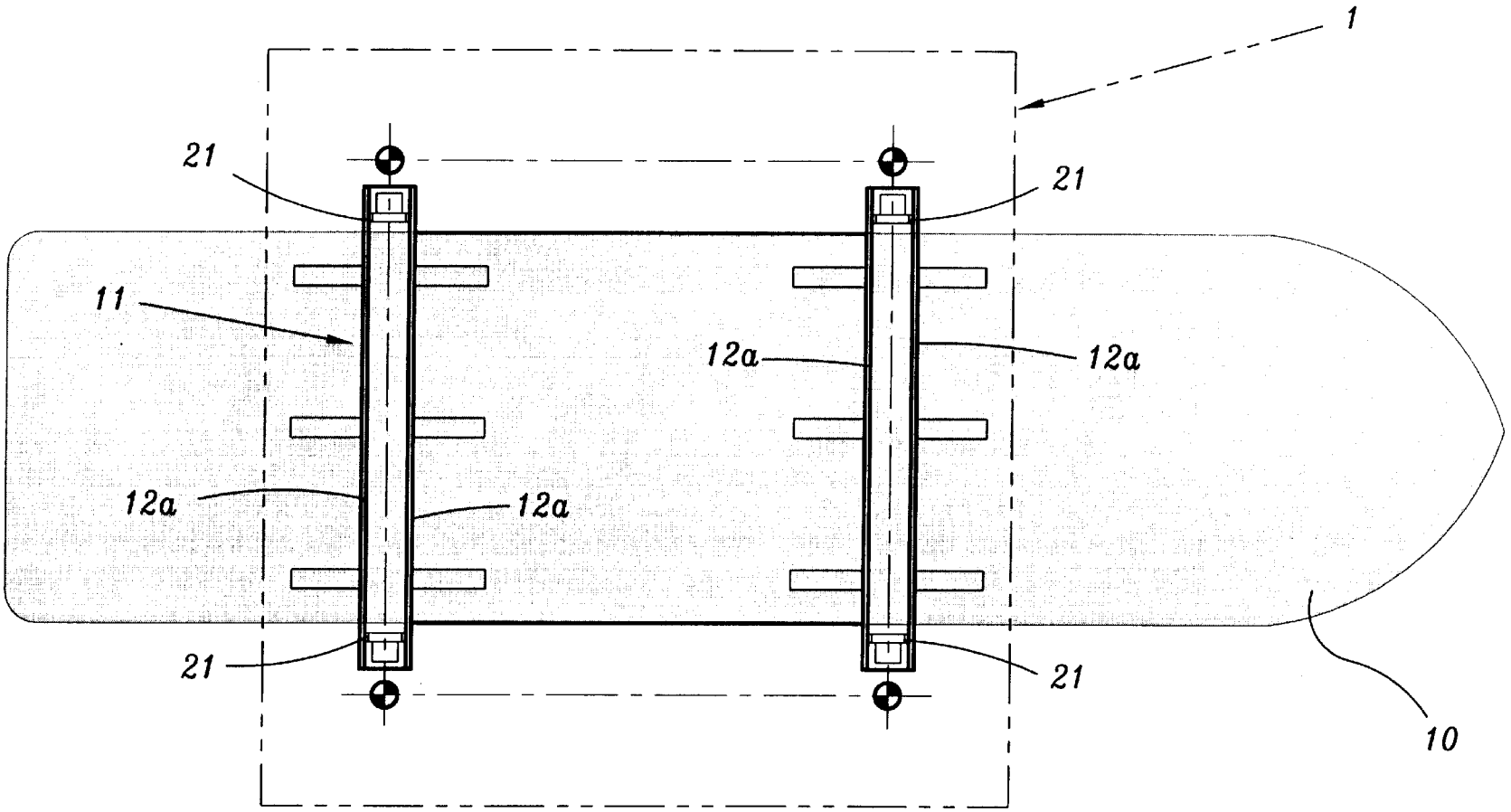
Figure 3:
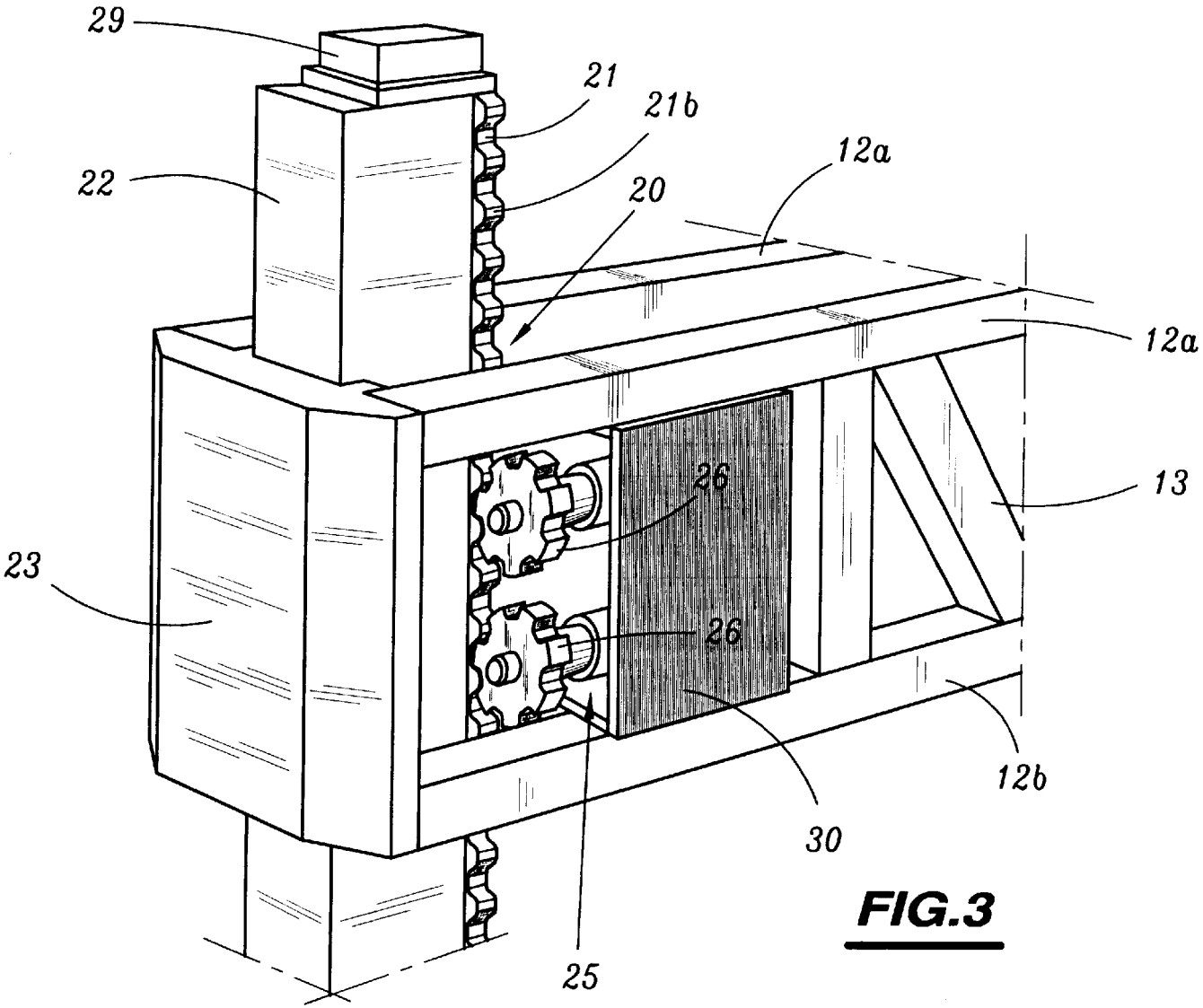
Figure 5:
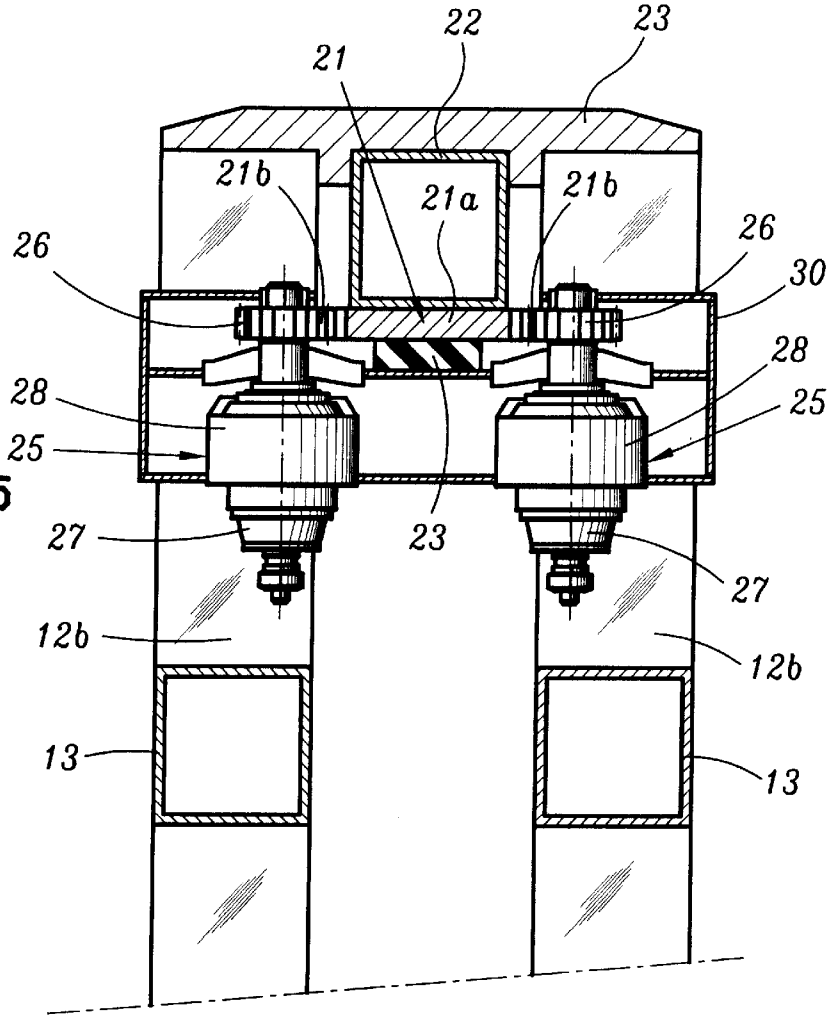
Figure 4:
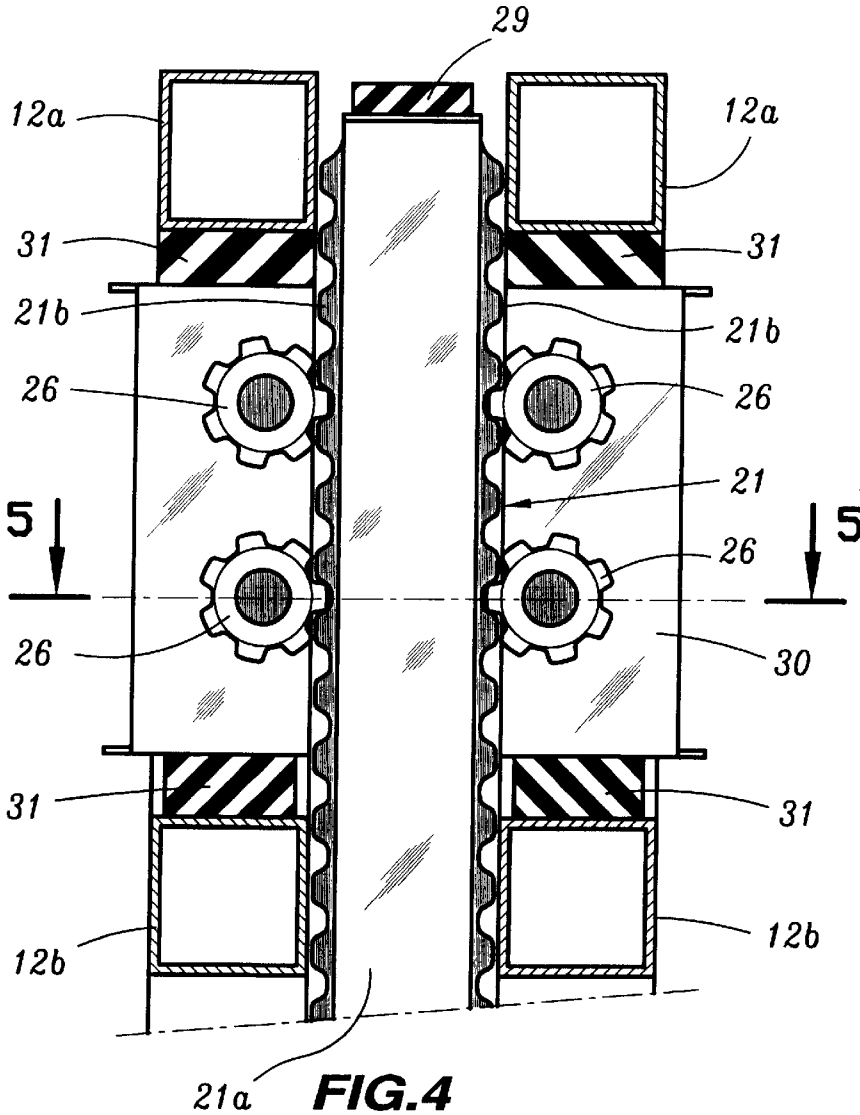
Figure 8:
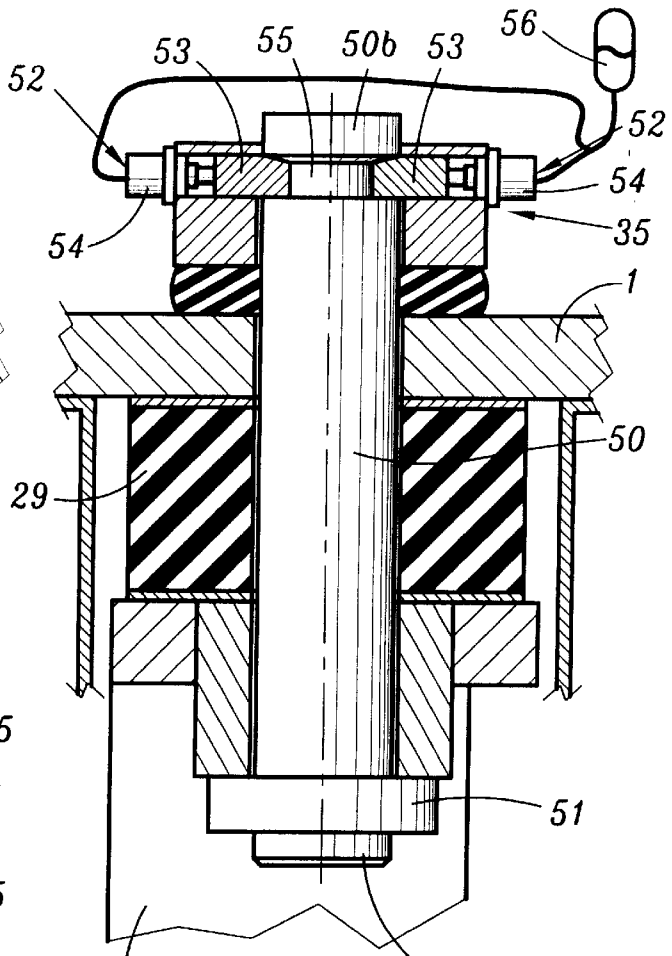
Figure 7:
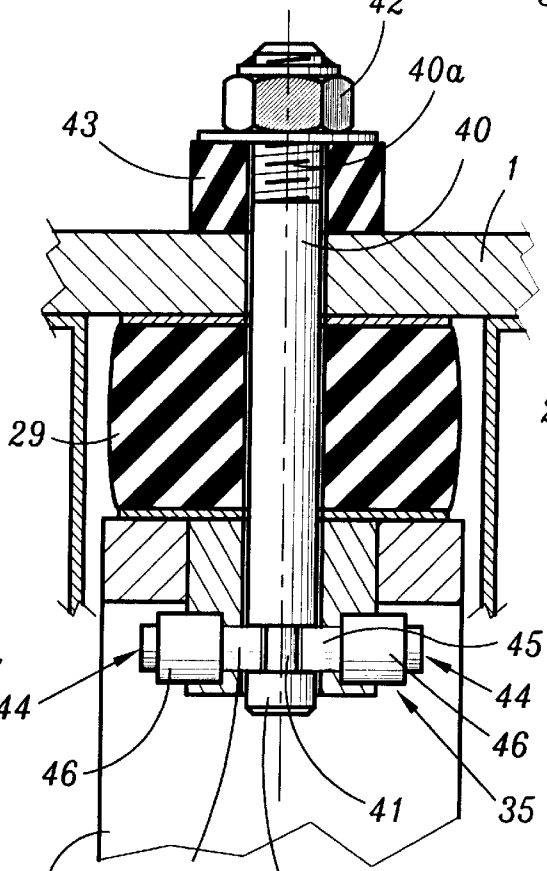
Figure 6:
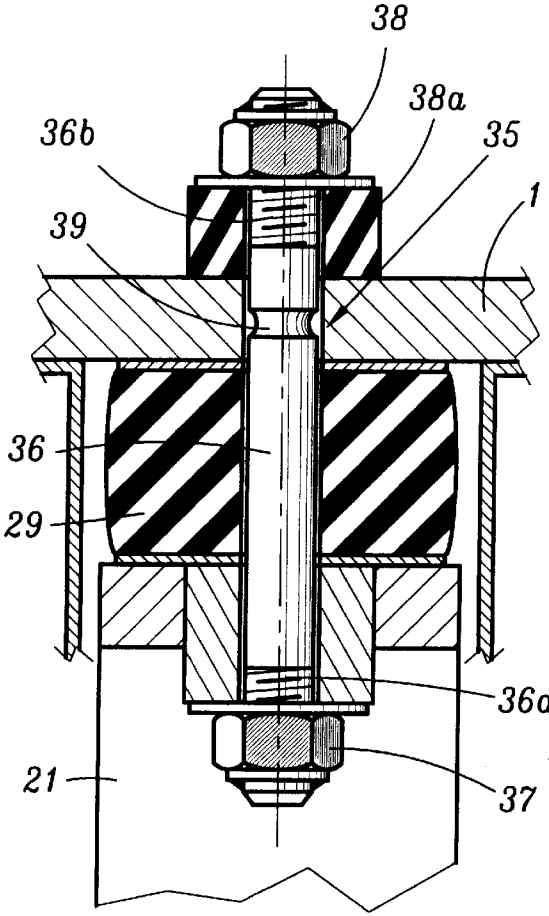
Figure 9:
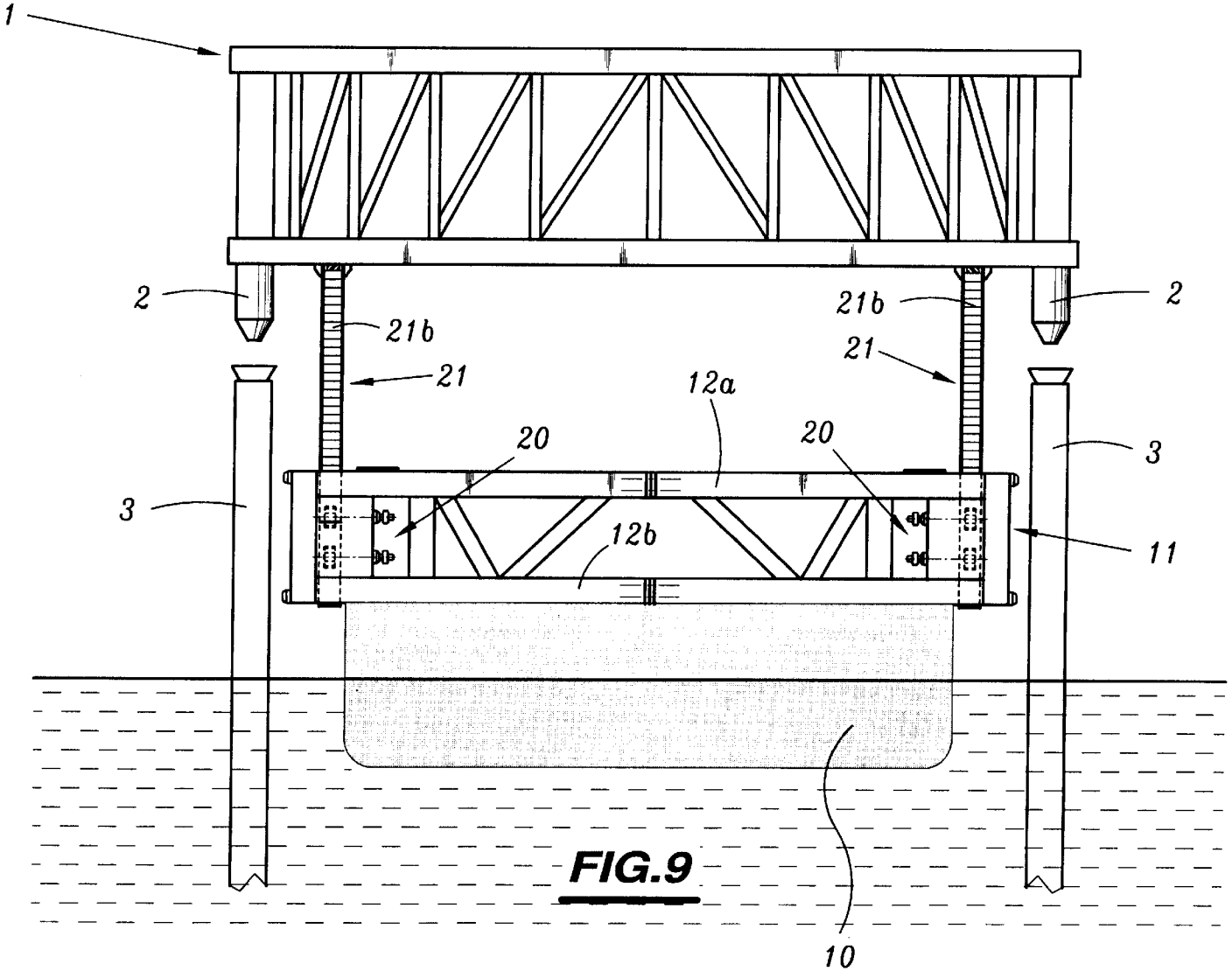
Figure 10:
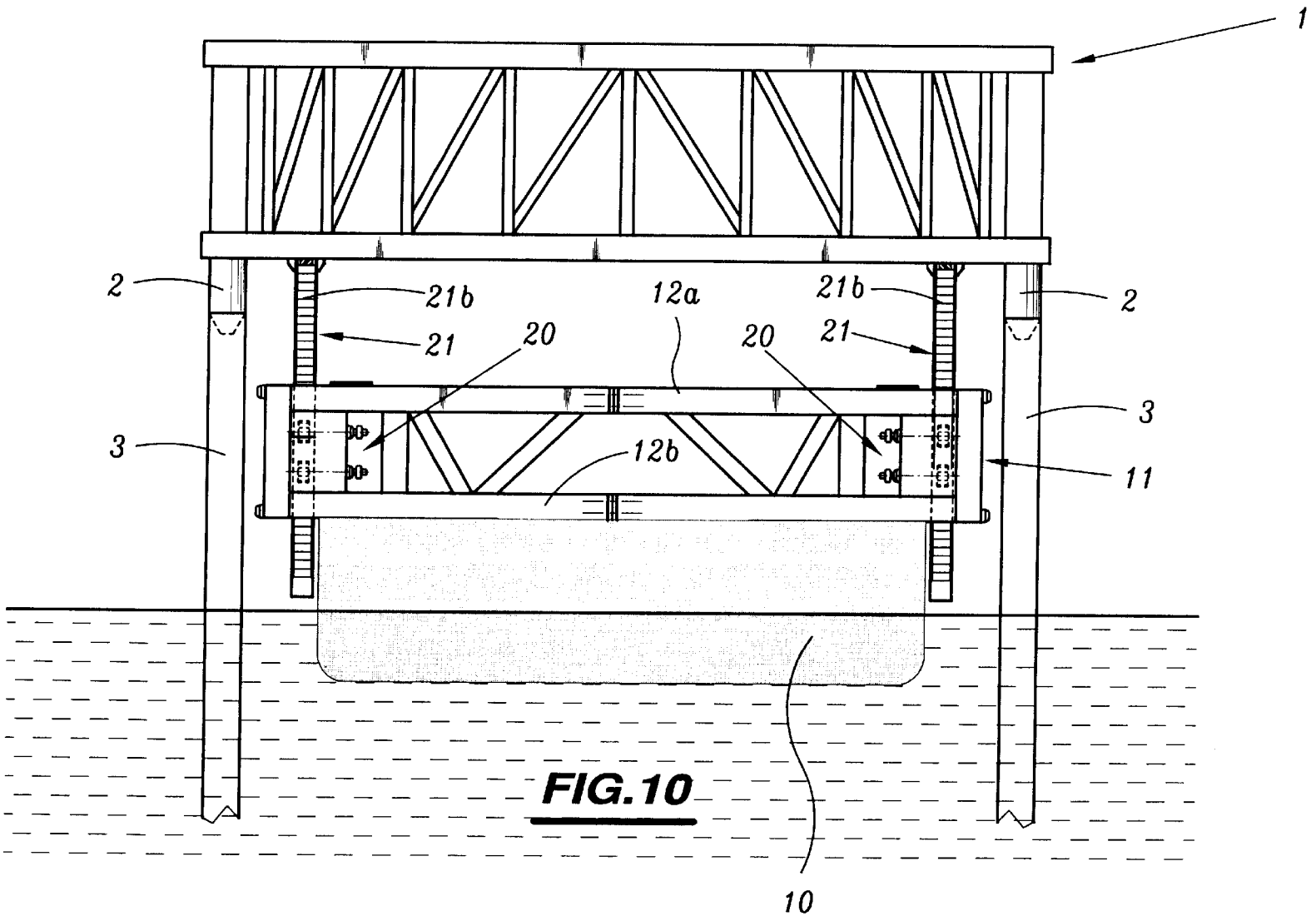
Figure 11:
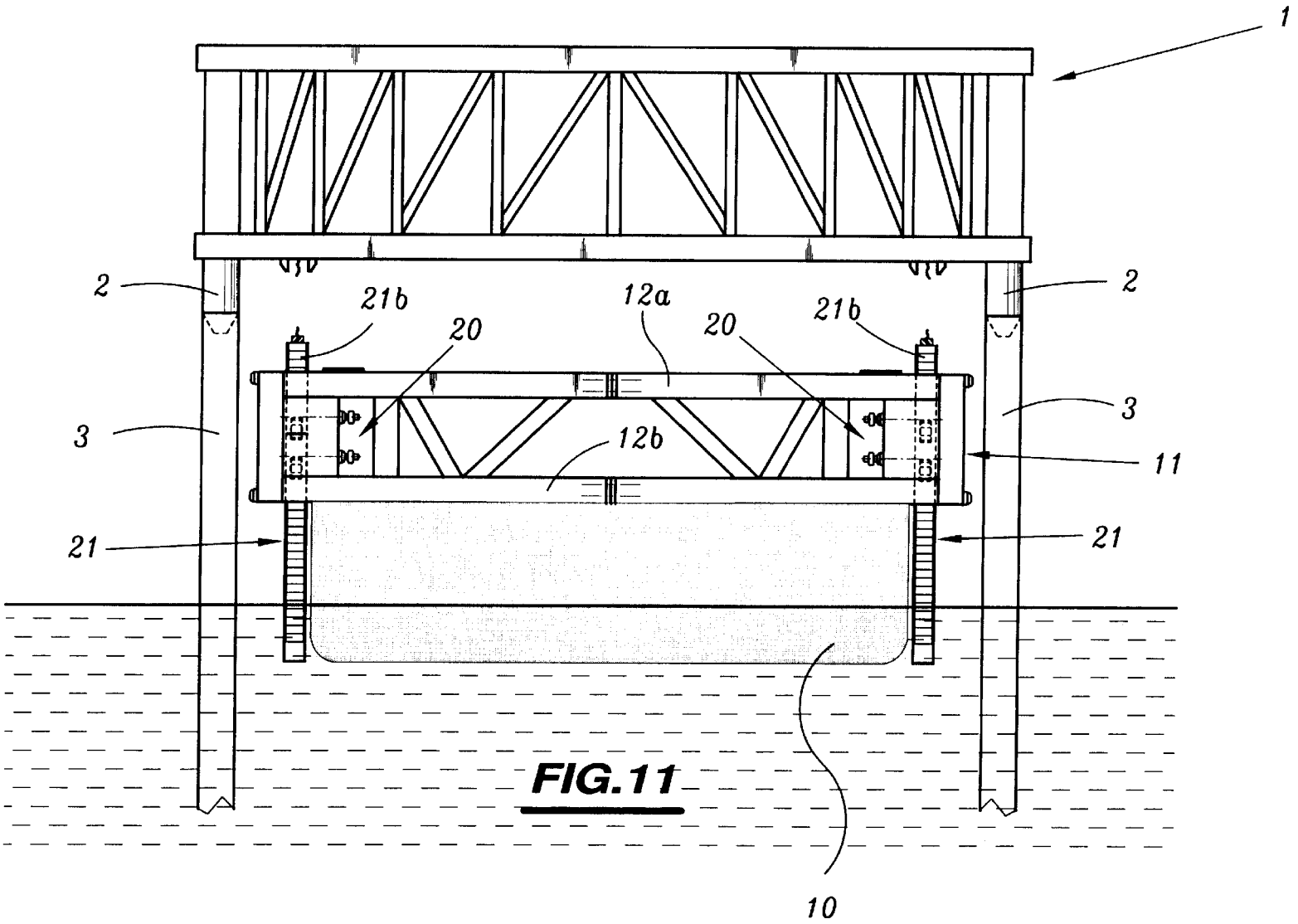

The invention will be more clearly understood from the following description given by way of example and with reference to the accompanying drawings in which:

FIG. 1 is a diagrammatic side view of apparatus in accordance with the invention for transporting and installing an oil platform deck, FIG. 2 is a diagrammatic plan view of the transportation and installation apparatus of the invention, FIG. 3 is a diagrammatic perspective view of equipment for moving the oil platform deck vertically, FIG. 4 is a diagrammatic elevation view of the equipment for moving the deck vertically, FIG. 5 is a sectional view taken along the line 5—5 in FIG. 4, FIG. 6 is a diagrammatic view in longitudinal section of a first embodiment of means for connecting the deck of the platform with the equipment for moving the deck vertically, FIG. 7 is a diagrammatic view in longitudinal section of a second embodiment of means for connecting the deck of the platform with the equipment for moving the deck vertically, FIG. 8 is a diagrammatic view in longitudinal section of a third embodiment of means for connecting the deck of the platform with the equipment for moving the deck vertically, and FIGS. 9 to 11 are diagrammatic views showing the various phases of installing the deck of the platform on the legs of the platform.

DETAILED DESCRIPTION OF THE INVENTION

FIGS. 1 and 2 show diagrammatically apparatus for transporting and installing a deck 1 of an offshore oil production platform.

The deck comprises an assembly of metal beams and has in its lower part feet 2 for locating it on the upper end of legs 3 for supporting the deck of the oil platform.

In the example shown in the figures, the deck is parallelepiped-shaped and there are four centring feet 2, one at each corner of the deck 1.

The apparatus for transporting and installing the deck 1 includes a floating barge 10 and a framework 11 for supporting the deck 1 adapted to be placed on the barge and including equipment for moving the deck 1 vertically.

The support framework 11 is formed by at least one top beam 12*a* and at least one bottom beam 12*b* which are separate from each other and linked by spacers 13.

In the embodiment shown in the figures, the support framework 11 is formed of two parallel top beams 12*a* and two parallel bottom beams 12*b*, the beams 12*a* and 12*b*being linked by the spacers 13.

The beams 12*a* and 12*b* support at each end the equipment for moving the deck 1 vertically which is formed by at least one rack 21 which can be moved vertically by a drive mechanism 20.

The combination of the beams 12*a* and 12*b*, the racks 21 and the drive mechanism 20 constitutes a module that is independent of the barge 10.

A plurality of independent modules can be placed parallel to each other on the barge 10, depending on the width of the deck to be supported, as shown in FIG. 2.

Also, the lengths of the beams 12*a* and 12*b* can be varied to modify the distance between the racks 21.

To this end, each beam 12*a* and 12*b* can comprise half-beams disposed in series and bolted together by means of flanges.

The modules formed by the beams 12*a* and 12*b* can be joined together by longitudinal beams, not shown, parallel to the axis of the barge 10.

There are two ways to install the deck 1 on the barge 10.

The first is to assemble the deck 1 directly on the support framework 11 on a quay in a shipyard.

When the deck 1 has been assembled, the combination of the support framework 11 and the deck 1 is transferred onto the barge 10, for example by appropriate lifting equipment, or by any other means.

The racks 21 are then installed on the support framework 11.

The second method is to place the support framework 11 directly on the barge 10 and to slide the deck 1 from the quay on which it is assembled onto the support framework 11.

In the embodiment shown in the figures, the means or system for moving the deck 1 from a position resting on the support framework 11 to a position resting on the ends of the legs 3 of the platform are formed by four racks 21 which can be moved vertically by drive mechanisms 20.

One of the systems for moving the deck 1 will now be described with reference to FIGS. 3 to 5, the others being identical.

Each system for moving the deck 1 includes the rack 21 consisting of a plate 21*a*(FIG. 5) with a series of teeth 21*b* on each of its lateral faces.

The plate 21*a* is fixed to a vertical beam 22.

The combination of the plate 21*a* and the vertical beam 22 is guided by two spacers 23 which are fixed to the ends of the corresponding beams 12a and 12b and between which the combination slides vertically.

As shown in FIG. 1, each rack 21 extends laterally relative to the hull of the barge 10 and is sufficiently long to enable the deck 1 to be raised.

Each rack 21 is moved vertically by drive mechanisms 20 supported by the beams 12*a* and 12*b* and comprising at least one combination 25 of an output gear 26 cooperating with one of the series of teeth 21*b* of the rack 21.

The output gear 26 is rotated by a motor 27 through at least one gearbox 28.

In the embodiment shown in the figures, the drive mechanism of each rack 21 is formed of four such combinations 25 opposed in pairs and each including a motor 27 associated with at least one gearbox 28 driving an output gear 26 cooperating with a series of teeth 21*b*of the rack 21.

The motors 27 driving the output gears 26 are hydraulic motors, for example.

As shown in FIGS. 3 and 4 in particular, the rack 21 has at its upper end a shoe 29 for absorbing impacts, and each of the combinations 25 is mounted in a structure 30 which is connected to the beams 12*a* and 12*b* of the support framework 11 by impact-absorbing units 31.

The shoes 29 and the impact-absorbing units 31 are blocks of elastomer material, for example.

In one particular embodiment, the apparatus for installing the deck 1 includes a connecting or connecting device for connecting each rack 21 to the deck 1 of the platform.

The connecting means 35 can be disconnected after ballasting the barge 10 to prevent the upper ends of the racks 21 from striking the deck 1 after the barge 10 separates from the deck 1.

In a first embodiment shown in FIG. 6, the connecting means 35 are formed by a rod 36 which is screwthreaded at each end.

The rod 36 has a first end 36*a* connected to the corresponding racks 21 by a nut 37 screwed onto the end 36*a* of the rod 36.

The other end 36*b* of the rod 36 is connected to the deck 1 by a nut 38 screwed onto the end 36*b*.

A resilient ring 38*a*, for example a ring of elastomer material, is placed between the nut 38 and the deck 1.

The rod 36, which is preferably a metal rod, has a portion 39 of small cross section designed to break at a particular load.

In a second embodiment shown in FIG. 7, the means 35 for connecting the rack 21 to the deck 1 of the platform comprise a rod 40, preferably a metal rod, which has a screwthreaded first end 40*a* and a second end 40*b* provided with a groove 41.

In the embodiment shown in FIG. 7, the end 40*a* of the rod 40 is connected to the deck 1 by a nut 42 screwed onto the end 40*a* and an elastic material ring 43, for example a ring of elastomer material, is placed between the nut 42 and the deck 1.

The end 40*b* of the rod 40 is connected to the rack 21 by at least one locking unit 44.

In this embodiment, the locking unit 44 is formed by two opposed fingers 45 which can be moved transversely relative to the axis of the rod 40 and each of which is operated by an actuator unit 46.

Each finger 45 cooperates with the groove 41 on the rod 40.

In a variant, the end 40*a* of the rod 40 can be connected to the deck 1 by the fingers 45 and the end 40*b*of the rod 40 can be connected to the rack 21 by a nut 42.

In a third embodiment shown in FIG. 8, the means 35 connecting the rack 21 to the deck 1 of the platform comprise a rod 50, preferably a metal rod, one end 50*a* of which is connected to the rack 21 by a shoulder 51 at the end 50*a* or by a ring fixed to that end 50*a*.

The other end 50*b* of the rod 50 is connected to the deck 1 by at least one locking unit 52 which, in the embodiment shown in FIG. 8, comprises two opposed fingers 53 which can be moved transversely relative to the axis of the rod 50.

Each finger 53 is wedge-shaped and is actuated by an actuator unit formed by a jack 54.

The wedge-shaped fingers 53 cooperate with a groove 55 at the end 50*b* of the rod 50 and which has a cross section complementary to the fingers 53.

The jacks 54 are controlled by accumulators 56 which assure calibrated withdrawal of the fingers 53 when a particular traction load is applied to the racks 21.

The various steps of transporting and installing the deck 1 of the platform by the apparatus in accordance with the invention will now be described with reference to FIGS. 1 and 9 to 11.

First of all, the deck 1, previously assembled on a quay in a shipyard, and the support framework 11 are transferred onto the barge 10, as shown in FIG. 1.

The deck 1 can simply be placed on the support framework 11 or connected to the framework by appropriate members as well as by the means 35 connecting the racks 21 to the deck 1.

The barge 10 transports the deck 1 to the offshore production site where the legs 3 of the platform have already been installed on the sea floor, as shown in FIG. 9.

The motors 27 of the drive mechanisms 25 are then operated and rotate the gears 26 through the gearboxes 28, which moves the racks 21 upwards and raises the deck 1 to a sufficient height for moving the locating feet 2 over the upper ends of the legs 3, as shown in FIG. 9.

The barge 10 is moved between the legs 3 of the platform to align the locating feet 2 with the axes of the ends of the legs 3.

The motors 27 of the drive mechanism 25 are then operated in the opposite direction to lower the deck 1 by means of the racks 21 to place the locating feet 2 on the ends of the legs 3, as shown in FIG. 10.

The weight of the deck 1, previously supported by the barge 10, is progressively transferred to the legs 3, with the result that the barge 10 tends to rise up and the ends of the racks 21 tend to strike the deck 1 if installation is being carried out during severe weather.

To prevent this, the racks 21 can be connected to the deck 1 of the platform by connecting means 35 which can be disconnected after ballasting the barge 10.

The barge 10 can be ballasted in two ways.

The first is to progressively flood the barge 10 with water to increase its weight.

As soon as the load applied by the barge 10 to the rods 36, 40 or 50, depending on the connecting means employed, reaches a particular value, the barge 10 separates from the deck 1 either because the rods 36 break or because the fingers 46 or 53 move to release the rods 40 or 50.

Because it has been ballasted, the barge 10 settles deeper in the water and the distance to the upper end of each rack 21 is accordingly sufficient for it not to strike the deck 1 after separation.

The second method of ballasting the barge 10 is to raise it progressively.

To this end the gears 26 are rotated by the motors 27 and the gearboxes 28.

Given that the deck 1 is resting on the legs 3 and that the racks 21 are connected to the deck 1 by the rods 36, 40 or 50, depending on the connecting means employed, rotation of the gears 26 progressively raises the barge 10 out of the water through the intermediary of the structures 30 supporting the drive mechanisms and the support framework 11 connected to the barge 10.

As soon as the load applied by the barge 10 to the rods 36, 40 or 50 reaches a particular value, the barge 10 separates from the deck 1 either because the rods 36 break or because the fingers 46 or 53 are moved to release the rods 40 or 50.

The barge 10 settles rapidly in the water and the gears 26, which continue to rotate, continue to lower the racks 21.

The distance between the upper ends of the racks 21 and the deck 20 is consequently sufficient to prevent the racks 21 from striking the deck 1 after separation.

The apparatus in accordance with the invention can quickly install a deck on the legs of an oil platform and move the deck through a height on the order of 10 to 20 meters, thanks to the long travel of the equipment for moving the deck vertically.

Also, the racks are very rigid, in particular with reference to lateral forces, which avoids the need for bulky guide members.

What is claimed is:

1. Apparatus for transporting and installing a deck (1) of an offshore oil production platform using a floating barge (10) adapted to support the deck (1), said apparatus comprising:

a system for moving the deck (1) between a position resting on the barge (10) and a position resting on legs of the platform;

a support framework (11) for supporting the deck (1) on the barge (10) and being coupled to said system, said support framework (11) comprising at least one top beam (12*a*) supporting at each end portion a rack (21) and a drive mechanism (20) to vertically move said rack and at least one bottom beam (12*b*) connected together by spacers (13) and extending generally horizontally; and a connecting device (35) for connecting each said rack (21) to the deck (1) in a manner that each said rack (21) can be disconnected from the deck (1) after ballasting the barge (10), said connecting device comprising a rod (36) one end (36*a*) of which is connected to said rack (21) and the other end (36*b*) of which can be connected to the deck (1), said rod (36) having a frangible portion (39) adapted to break at a particular load, said frangible portion having a reduced cross section relative to other portions of said rod.

2. Apparatus according to claim 1, wherein said drive mechanism is operable to both raise and lower each said rack relative to at least one top beam.

3. Apparatus for transporting and installing a deck (1) of an offshore oil production platform using a floating barge (10) adapted to support the deck (1), said apparatus comprising:

a system for moving the deck (1) between a position resting on the barge (10) and a position resting on legs of the platform;

a support framework (11) for supporting the deck (1) on the barge (10) and being coupled to said system, said support framework (11) comprising at least one top beam **(12*a*) supporting at each end portion a rack (21) and a drive mechanism (20) to vertically move said rack and at least one bottom beam (12*b*) connected together by spacers (13) and extending generally horizontally; and a connecting device (35) for connecting each said rack (21) to the deck (1) in a manner that each said rack (21) can be disconnected from the deck (1) after ballasting the barge (10), said connecting device comprising a rod (40;50) a first end of which is connectable to said rack (21) and a second end of which is connectable to the deck (1), a connection finger (45;53) movably mounted for transverse movement relative to a longitudinal axis of said rod between a rod connecting state in which said connection finger connects one of said first and second ends of said rod to a respective one of said rack and the deck, and a rod disconnecting state, and an actuator unit (44;52) to actuate said connection finger (45;53)** to move between said rod connecting state and said rod disconnecting state.

4. Apparatus according to claim 3, wherein said connection finger (53) is wedge-shaped and said rod has a groove (55) therein with a cross section of complementary shape to said connection finger (53).

5. Apparatus according to claim 3, wherein said actuator unit comprises a jack (46;54).

6. Apparatus according to claim 3, wherein said connection finger is disposed at said first end of said rod.

7. Apparatus according to claim 3, wherein said connection finger is disposed at said second end of said rod.

8. Apparatus according to claim 3, wherein said drive mechanism is operable to both raise and lower each said rack relative to at one least one top beam.

* * * * *